US007703648B2

(12) United States Patent
Tamura et al.

(10) Patent No.: US 7,703,648 B2
(45) Date of Patent: Apr. 27, 2010

(54) GAS COMBUSTION TYPE DRIVING TOOL

(75) Inventors: Junichi Tamura, Tokyo (JP); Katsuhiko Murayama, Tokyo (JP)

(73) Assignee: Max Co., Ltd., Tokyo (JP)

( * ) Notice: Subject to any disclaimer, the term of this patent is extended or adjusted under 35 U.S.C. 154(b) by 218 days.

(21) Appl. No.: 12/063,084

(22) PCT Filed: Aug. 7, 2006

(86) PCT No.: PCT/JP2006/315598

§ 371 (c)(1),
(2), (4) Date: Feb. 6, 2008

(87) PCT Pub. No.: WO2007/018178

PCT Pub. Date: Feb. 15, 2007

(65) Prior Publication Data

US 2009/0224022 A1 Sep. 10, 2009

(30) Foreign Application Priority Data

Aug. 8, 2005 (JP) ..... 2005-229364

(51) Int. Cl.
*B25C 1/14* (2006.01)
*B25C 1/04* (2006.01)

(52) U.S. Cl. ..... 227/8; 227/10; 227/9; 227/142

(58) Field of Classification Search ..... 227/8, 227/10, 9, 142
See application file for complete search history.

(56) References Cited

U.S. PATENT DOCUMENTS 4,483,280 A * 11/1984 Nikolich ..... 123/46 SC
4,483,473 A * 11/1984 Wagdy ..... 227/8
4,483,474 A * 11/1984 Nikolich ..... 227/8
4,522,162 A * 6/1985 Nikolich ..... 123/46 SC
4,784,308 A 11/1988 Novak et al.
5,909,836 A * 6/1999 Shkolnikov et al. ..... 227/8
6,016,945 A * 1/2000 Phillips et al. ..... 227/10
6,145,724 A * 11/2000 Shkolnikov et al. ..... 227/8
7,175,063 B2 * 2/2007 Osuga et al. ..... 227/8

(Continued)

FOREIGN PATENT DOCUMENTS

EP 1 053 834 A2 11/2000

(Continued)

*Primary Examiner*—Brian D Nash
(74) *Attorney, Agent, or Firm*—Drinker Biddle & Reath LLP

(57) ABSTRACT

When a movable sleeve 11 on a cylinder moves upward, a combustion chamber 5 in a sealed state is formed. Mixed gas is explosively burnt within the combustion chamber 5 so as to drive a fastener out. A lock cylinder 22 is disposed beneath the movable sleeve 11. A lock piston 23 is housed within the lock cylinder 22 so as to be movable in an up/down direction. The upper end of the lock piston 23 is capable of being engaged with a holding member 12 which is interlocked with the movable sleeve 11. The lower portion of the lock cylinder is coupled to the combustion chamber via a gas tube 24. The gas tube 24 is provided with a check valve 25. The lock cylinder 22 is provided with an electromagnetic valve 27. The electromagnetic valve 27 opens upon the lapse of a predetermined time period after the combustion within the combustion chamber.

9 Claims, 8 Drawing Sheets

U.S. PATENT DOCUMENTS

| | | | | |
|---|---|---|---|---|
| 7,556,182 | B2 * | 7/2009 | Murayama et al. | 227/10 |
| 2005/0173487 | A1 * | 8/2005 | Moeller et al. | 227/10 |
| 2005/0218179 | A1 * | 10/2005 | Akiba et al. | 227/10 |
| 2006/0157528 | A1 * | 7/2006 | Osuga et al. | 227/130 |
| 2008/0141921 | A1 * | 6/2008 | Hinderks | 114/274 |
| 2008/0314951 | A1 * | 12/2008 | Kosuge et al. | 227/10 |
| 2008/0314952 | A1 * | 12/2008 | Tamura et al. | 227/10 |
| 2009/0032564 | A1 * | 2/2009 | Takemura et al. | 227/10 |
| 2009/0071999 | A1 * | 3/2009 | Tamura et al. | 227/10 |
| 2009/0255973 | A1 * | 10/2009 | Tamura et al. | 227/9 |

FOREIGN PATENT DOCUMENTS

| | | |
|---|---|---|
| JP | 59-205273 | 11/1984 |
| JP | 11-216684 | 8/1999 |
| JP | 2004-74296 | 3/2004 |
| JP | 2004-74297 | 3/2004 |

* cited by examiner

GAS COMBUSTION TYPE DRIVING TOOL

TECHNICAL FIELD

The present invention relates to a gas combustion type driving tool which is arranged to explosively burn mixed gas of combustible gas and the air within a combustion chamber, which is formed by moving a movable sleeve upward to seal a space thereof, thereby to perform impulsively driving, and in particular relates to the combustion chamber holding mechanism of the gas combustion type driving tool which holds the movable sleeve at an upper position for a predetermined time period after the combustion.

BACKGROUND ART

In some kinds of gas combustion type driving tools, combustible gas is injected into a combustion chamber sealed within a body, then mixed gas of the combustible gas and the air is stirred within the combustion chamber, and the mixed gas thus stirred is burnt within the combustion chamber to generate high-pressure combustion gas within the combustion chamber. The high-pressure combustion gas acts on a striking piston housed within a striking cylinder to impulsively drive the striking piston within the striking cylinder. A nail supplied to a nose portion beneath the body is driven into a steel plate or concrete by a driver coupled to the lower surface side of the striking piston. Such the combustion-gas driven driving machine is formed as a portable tool in a manner that a vessel such as a gas container filed with the combustible gas is attached within the tool and a battery acting as a power source for igniting the combustible gas is attached to the tool. Thus, the combustion-gas driven driving machine can perform the driving procedure of a nail or a pin without being restricted by a source of drive such as electric power or compressed air.

In the aforesaid gas combustion type driving tool, the striking piston is provided so as to be slidable in an up/down direction within the striking cylinder disposed within the body. The movable sleeve fitted on the outside of the striking cylinder so as to be movable in the up/down direction moves upward and abuts against a cylinder head provided above the striking cylinder to seal a space, whereby the combustion chamber can be configured. The movable sleeve is interlocked with a contact arm mechanism serving as a safety device. When the tip end of the contact arm is pressed against a member to be driven and is moved upward relatively with respect to the body, simultaneously the movable sleeve moves upward, whereby the combustion chamber sealed between the cylinder head and the striking cylinder is formed. When the contact arm restores to the original state, the movable sleeve also moves downward to open the combustion chamber.

The pulling operation of a trigger is made possible for the first time after the contact arm is pressed against the driven member and so the combustion chamber is formed. Further, if the trigger is not kept to be pulled, the movable sleeve moves downward and so the sealed state of the combustion chamber can not be held. JP-A-2004-074296 discloses an example of such a gas combustion type driving tool.

However, in the case where the trigger is released immediately after the trigger is pulled to drive the tool or in the case where the body separates instantaneously from the driven member due to the reaction at the time of the driving operation, there may arises a case that the contact arm also moves downward due to the urging force of a spring and hence the sealing state of the combustion chamber is lost. If the combustion chamber is opened at the early timing, since the pressure within the combustion chamber is not reduced sufficiently, there arises a phenomenon that the striking piston cannot return to the top dead center. In this case, the striking force at the next striking operation becomes insufficient and so a fastener rises from the driven member disadvantageously.

DISCLOSURE OF THE INVENTION

One or more embodiments of the invention provides a combustion chamber holding mechanism of a gas combustion type driving tool which can surely hold a sealing state of a combustion chamber irrespective of an early or late operation of a trigger or the reaction at the time of a driving operation etc.

According to one or more embodiments of the invention, in a gas combustion type driving tool, a striking piston is provided so as to be slidable in an up/down direction within a striking cylinder disposed within a body, and a movable sleeve fitted on an outside of the striking cylinder so as to be movable in the up/down direction is moved upward to abut against a cylinder head provided above the striking cylinder thereby to make it possible to form a sealed combustion chamber. Mixed gas obtained by mixing and stirring combustible gas and air is burnt explosively within the combustion chamber, the high-pressure combustion gas is acted on the striking piston to drive the piston impulsively, and so a fastener is driven out by a driver coupled at the lower surface side of the striking piston. A lock cylinder is disposed beneath the movable sleeve and a lock piston is housed within the lock cylinder so as to be movable in the up/down direction. The upper end of the lock piston is made capable of engaging with the holding member which is interlocked with the movable sleeve. The lower portion of the lock cylinder is coupled to the combustion chamber via a gas path. A check valve is provided at the gas path and an electromagnetic valve is provided at the lock cylinder. The electromagnetic valve is opened upon the lapse of a predetermined time period after the combustion within the combustion chamber.

Further, according to one or more embodiments of the invention, the electromagnetic valve may be replaced by a manually-operated valve.

According to one or more embodiments of the invention, since the lower portion of the lock cylinder is coupled to the combustion chamber via the gas path, when the mixed gas within the combustion chamber is burnt explosively and the driving operation is performed, a part of the combustion gas is supplied to the lock cylinder via the gas path to push the lock piston up. Thus the upper end of the lock piston engages with the holding member located at the upper position together with the movable sleeve which already moves upward to constitute the combustion chamber. After the driving operation, although the pressure within the combustion chamber reduces, since the gas within the gas path is prevented from flowing backward by the check valve, the pressure within the lock cylinder does not reduce. Thus the lock piston is kept at the same state and so the sealed state of the combustion chamber is held. Thereafter, upon the lapse of the predetermined time period, the electromagnetic valve is opened and hence the combustion gas within the gas path is exhausted. Thus, the lock piston moves downward and also the movable sleeve moves downward together with the holding member, the combustion chamber is opened.

Thus, the sealing state of the combustion chamber can be surely held irrespective of the early or late operation of the trigger or the reaction at the time of the driving operation etc.

Furthermore, according to one or more embodiments of the invention, when the manually-operated valve is employed in place of the electromagnetic valve, the holding of the sealed state of the combustion chamber can be freely controlled in accordance with the judgment of a worker.

Other aspects and advantages of the invention will be apparent from the following description and the appended claims.

EXPLANATION OF REFERENCE NUMERAL

Figure 1:
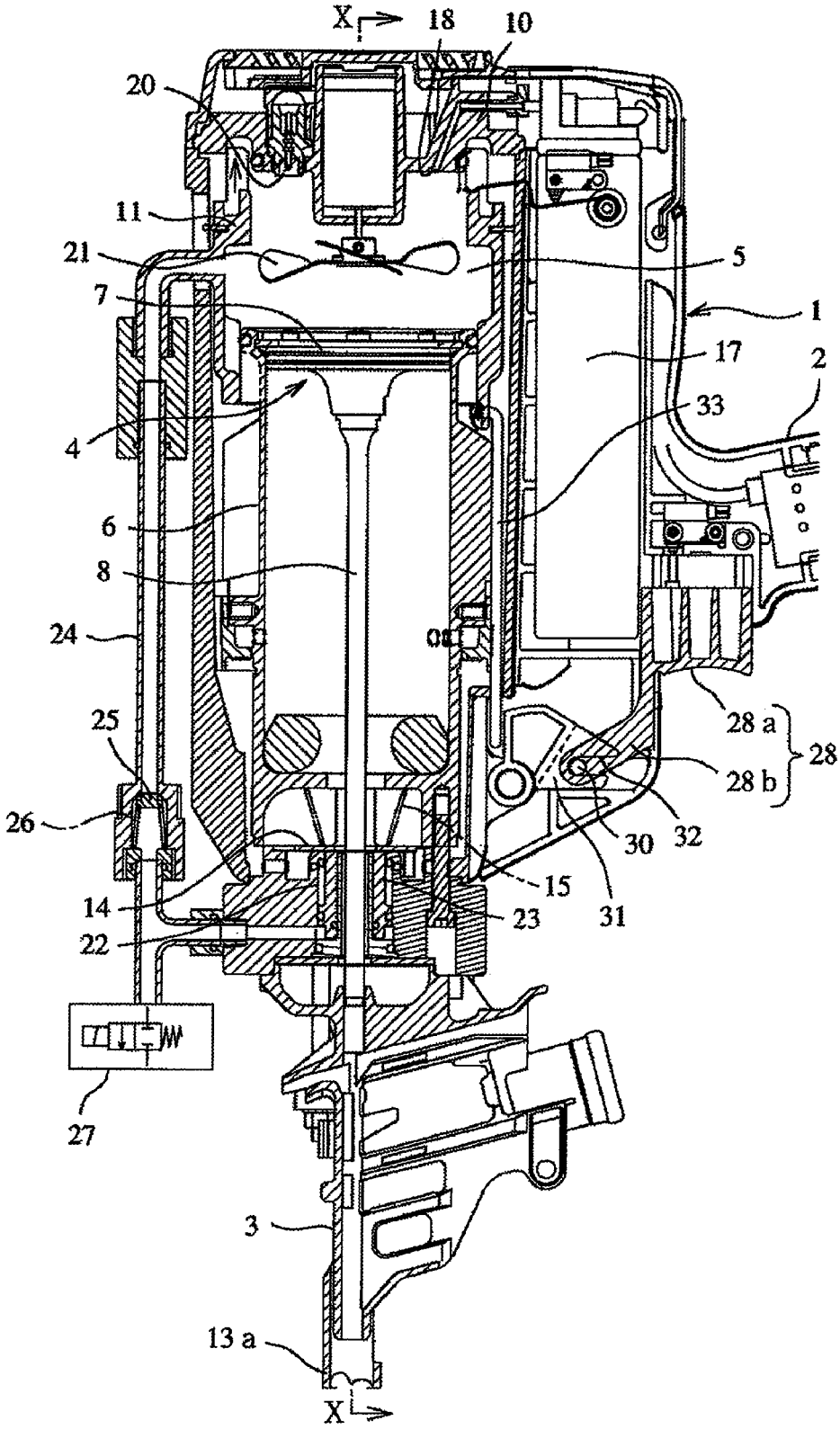
FIG. 1 is a longitudinal sectional diagram showing a main portion of a gas combustion type nail driving machine at the time of a non-operation state.

5 combustion chamber
11 movable sleeve
22 lock cylinder
23 lock piston
24 gas tube
25 check valve
27 electromagnetic valve

BEST MODE FOR CARRYING OUT THE INVENTION

Hereinafter, an exemplary embodiment of the invention will be explained with reference to drawings.

Figure 2:
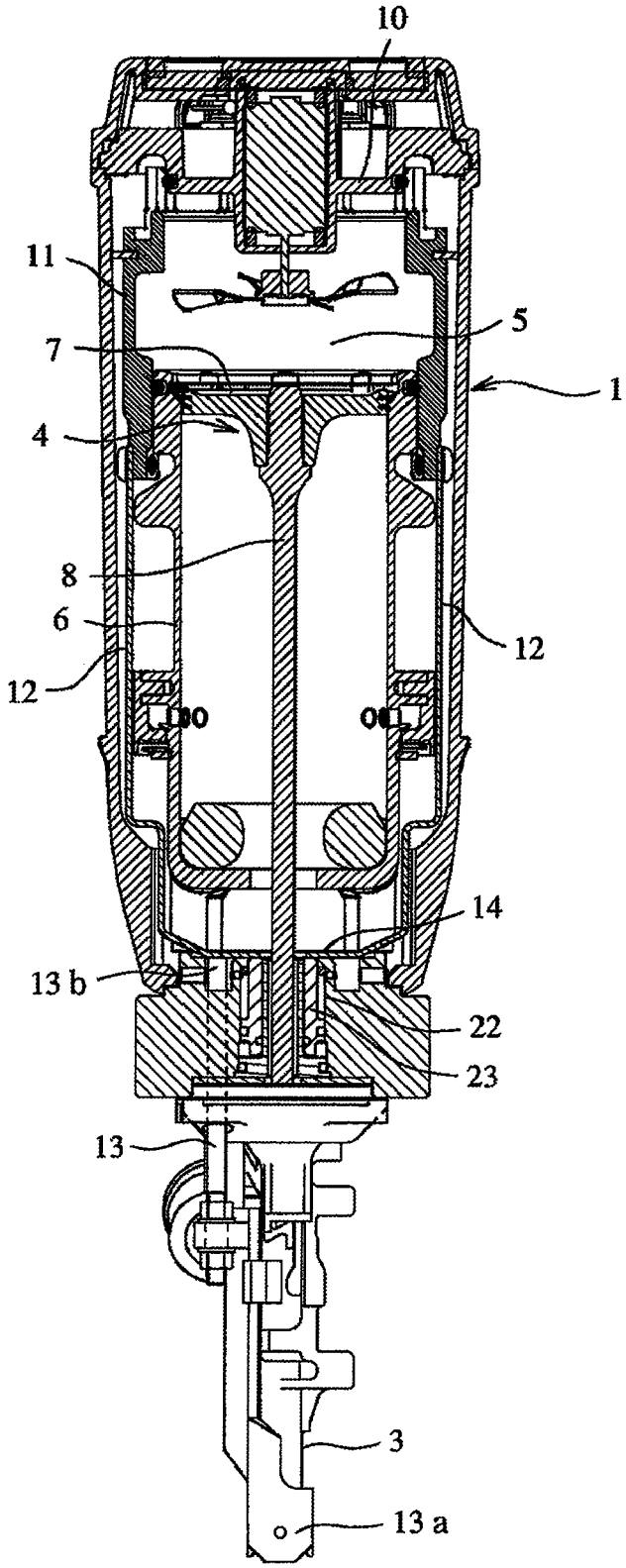
FIG. 2 is a longitudinal sectional diagram on a line X-X in FIG. 1.

In FIGS. 1 and 2, a symbol 1 depicts the tool main body of a nail driving machine as an example of a gas combustion type driving tool. A grip 2 and a magazine (not shown) are continuously formed at the body 1, and a striking piston cylinder mechanism 4 is provided within the body. A nose portion 3 for driving out a nail is provided beneath the body 1.

The striking piston cylinder mechanism 4 is configured to house a striking piston 7 within a striking cylinder 6 so as to be slidable freely and to integrally couple a driver 8 beneath the striking piston 7.

Next, a combustion chamber 5 is configured above the striking cylinder 6 so as to be able to seal and open the space thereof. The combustion chamber 5 is formed by the upper end surface of the striking piston 7 and an annular movable sleeve 11 disposed between the striking cylinder 6 and a cylinder head 10 formed within an upper housing. The combustion chamber 5 is formed when the movable sleeve 11 is moved as shown by an arrow until the sleeve abuts against the cylinder head 10, whilst the upper portion of the combustion chamber 5 communicates with the atmosphere when the sleeve is moved downward.

The movable sleeve 11 links with a contact arm 13 via a link-shaped holding member 12. A basket-shaped bottom portion 14 disposed beneath the striking cylinder 6 is formed at the lower end of the holding member 12. The basket-shaped bottom portion 14 is urged downwardly by a spring 15 provided between the basket-shaped bottom portion and the lower surface of the striking cylinder 6. The contact arm 13 is provided so as to be freely movable in the up/down direction along the nose portion 3 provided beneath the striking cylinder 6. The lower end 13*a* of the contact arm protrudes from the nose portion 3, and the contact arm moves upward relatively with respect to the nose portion 3 when the lower end is pressed together with the nose portion 3 against a driven member P to be driven. An upper end 13*b* is disposed so as to be able to engage with the lower surface of the basket-shaped bottom portion 14. The spring 15 is disposed between the upper surface of the basket-shaped bottom portion 14 and the lower surface of the striking cylinder 6. The contact arm 13 and the movable sleeve 11 are urged by the spring 15 so as to be always located at the lower positions, respectively.

Within the upper housing, there are disposed an injection nozzle 18 communicating with a gas vessel 17 and an ignition plug 20 for igniting and burning mixed gas. Further, at the upper housing, there is provided with a rotary fan 21 for stirring and mixing combustible gas injected within the combustion chamber 5 with the air within the combustion chamber 5 to generate mixed gas of a predetermined air-fuel ratio within the combustion chamber 5.

Figure 3:
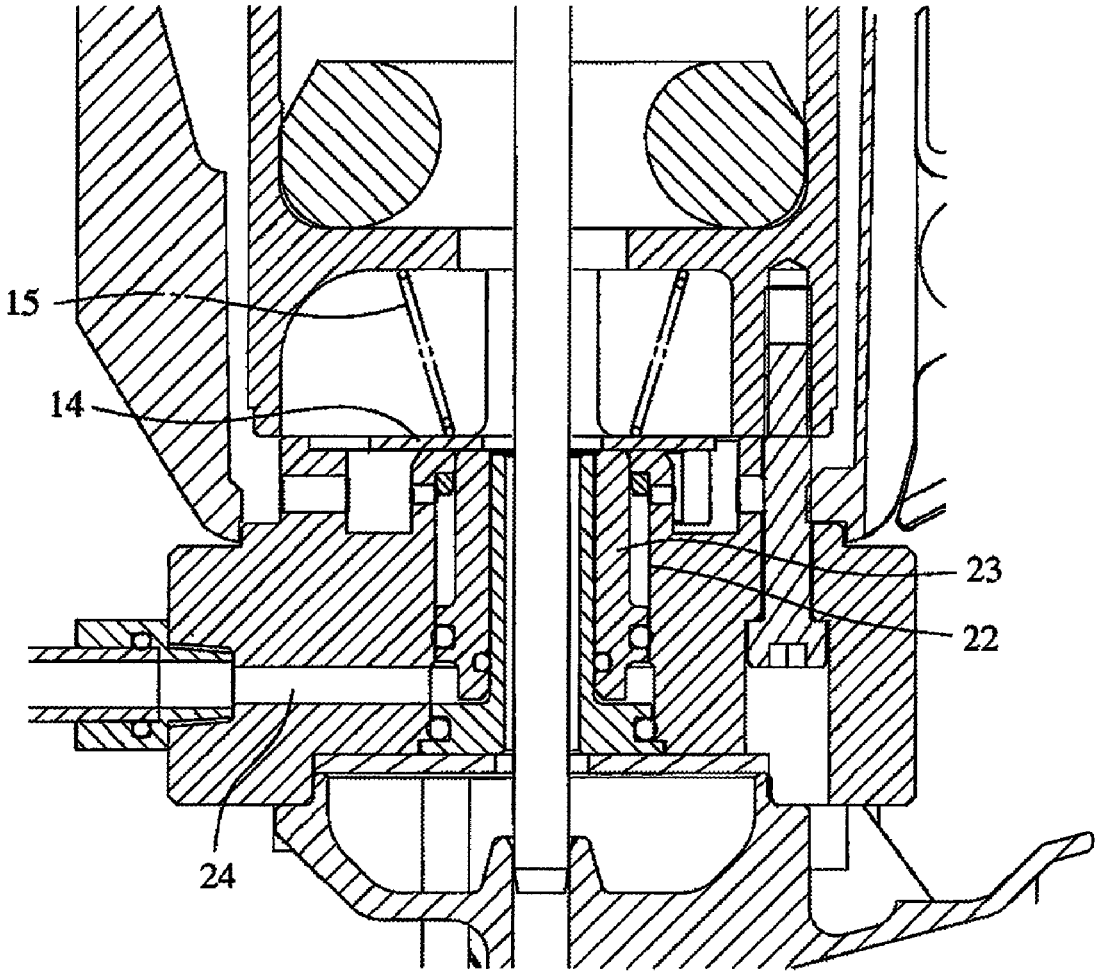
FIG. 3 is an enlarged diagram of a lock piston and a lock cylinder.

Next, as shown in FIG. 3 in detail, a lock cylinder 22 is disposed beneath the striking cylinder 6. The lock cylinder 22 is formed in a doughnut shape so as to surround the driver 8. A cylindrical lock piston 23 is housed within the lock cylinder 22 so as to be movable in the up/down direction. The upper end of the lock piston 23 is disposed so as to be able to engage with the holding member 12 which is interlocked with the movable sleeve 11.

The lower portion of the lock cylinder 22 is coupled with the combustion chamber 5 via a gas tube 24 serving as a gas path. A check valve 25 is provided on the way of the gas tube 24. The check valve 25 is provided in order to prevent the gas within the gas tube 24 from flowing backward to the combustion chamber 5 side by a spring 26. Further, the lock cylinder 22 is provided with an electromagnetic valve 27 serving as a valve device. The electromagnetic valve 27 is set to be opened upon the lapse of a predetermined time period after the combustion within the combustion chamber 5. The predetermined time period is a time period from a time point where the driving operation starts to a time point where the driving operation is completed and the striking piston 7 moves and restores to the top dead center.

A trigger 28 for turning on and off an ignition switch for the ignition plug 20 is provided at the base portion of the grip 2. That is, the trigger 28 is configured by a trigger main body 28*a* and an arm 28*b* of a J-shape and is movable in the up/down direction. An engagement shaft 30 is formed protrusively at the lower end of the arm 28*b*. The engagement shaft 30 engages with engagement grooves 32 of a lock plate 31 which is provided at the body 1 so as to be rotatable freely. Thus, the lock plate 31 is configured to rotate upward when the trigger 28 is raised upward. The upper portion of the lock plate 31 is able to engage with a lockout bar 33 linked with the movable sleeve 11.

Figure 4:
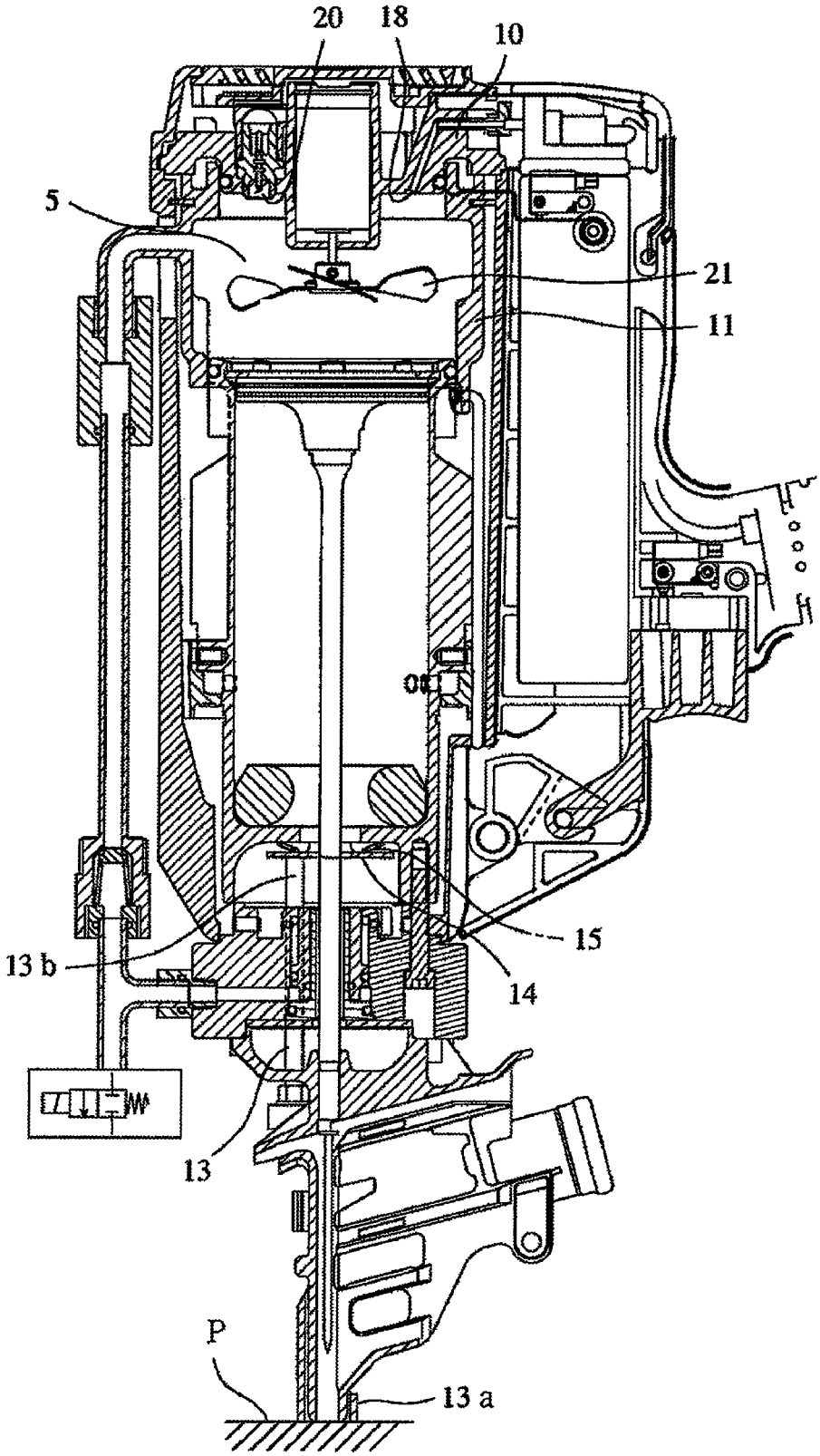
FIG. 4 is a longitudinal sectional diagram showing a state at the time of starting a driving operation of the nail driving machine.
Figure 5:
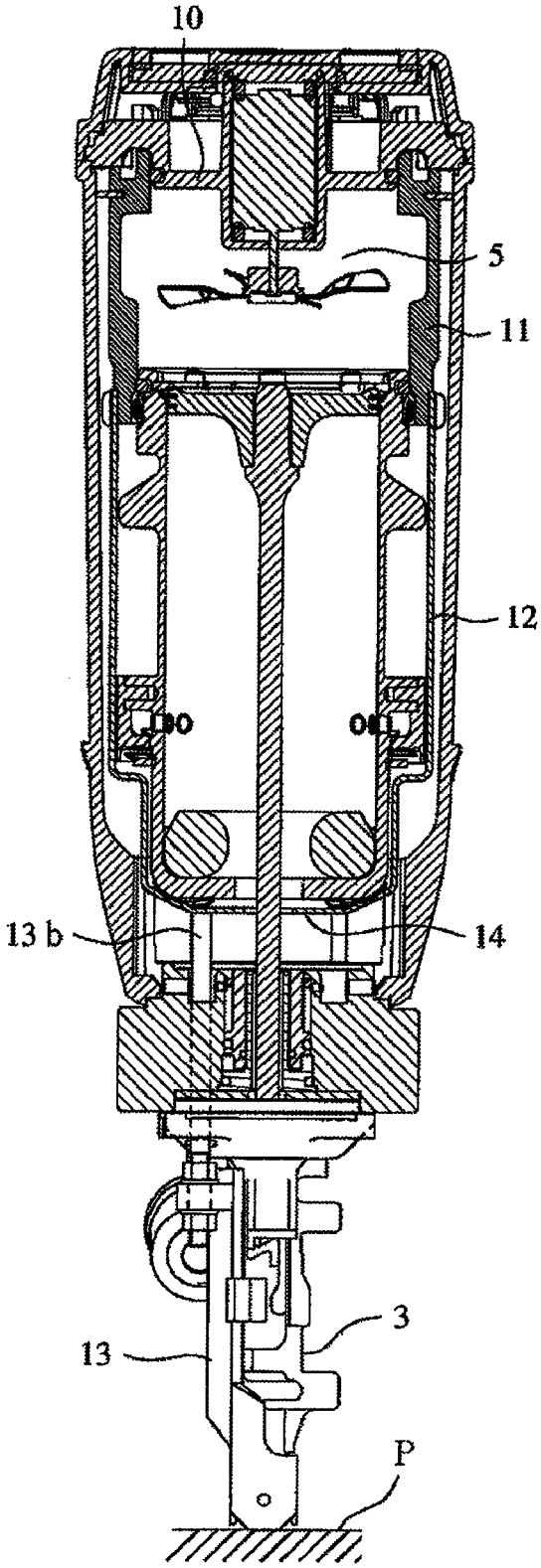
FIG. 5 is a longitudinal sectional diagram showing a state at the time of starting the driving operation with the same section as FIG. 2.

Next, the operation of the holding mechanism of the combustion chamber 5 will be explained. First, at the time of driving a nail, as shown in FIGS. 4 and 5, the lower end 13*a* of the contact arm 13 is pressed strongly against the driven member P to relatively move the contact arm 13 upward. Thus, the upper end 13*b* moves the basket-shaped bottom portion 14 of the holding member 12 upward against the spring 15 to move the movable sleeve 11 upward thereby to abut against the cylinder head 10 provided above the striking cylinder 6, whereby the combustion chamber 5 in the sealed state is formed. The combustible gas is injected into the combustion chamber 5 from the injection nozzle 18 and the rotary fan 21 rotates to stir and mix the combustible gas with the air.

The holding member 12 and the basket-shaped bottom portion 14 move upward in accordance with the upper movement of the contact arm 13.

Figure 6:
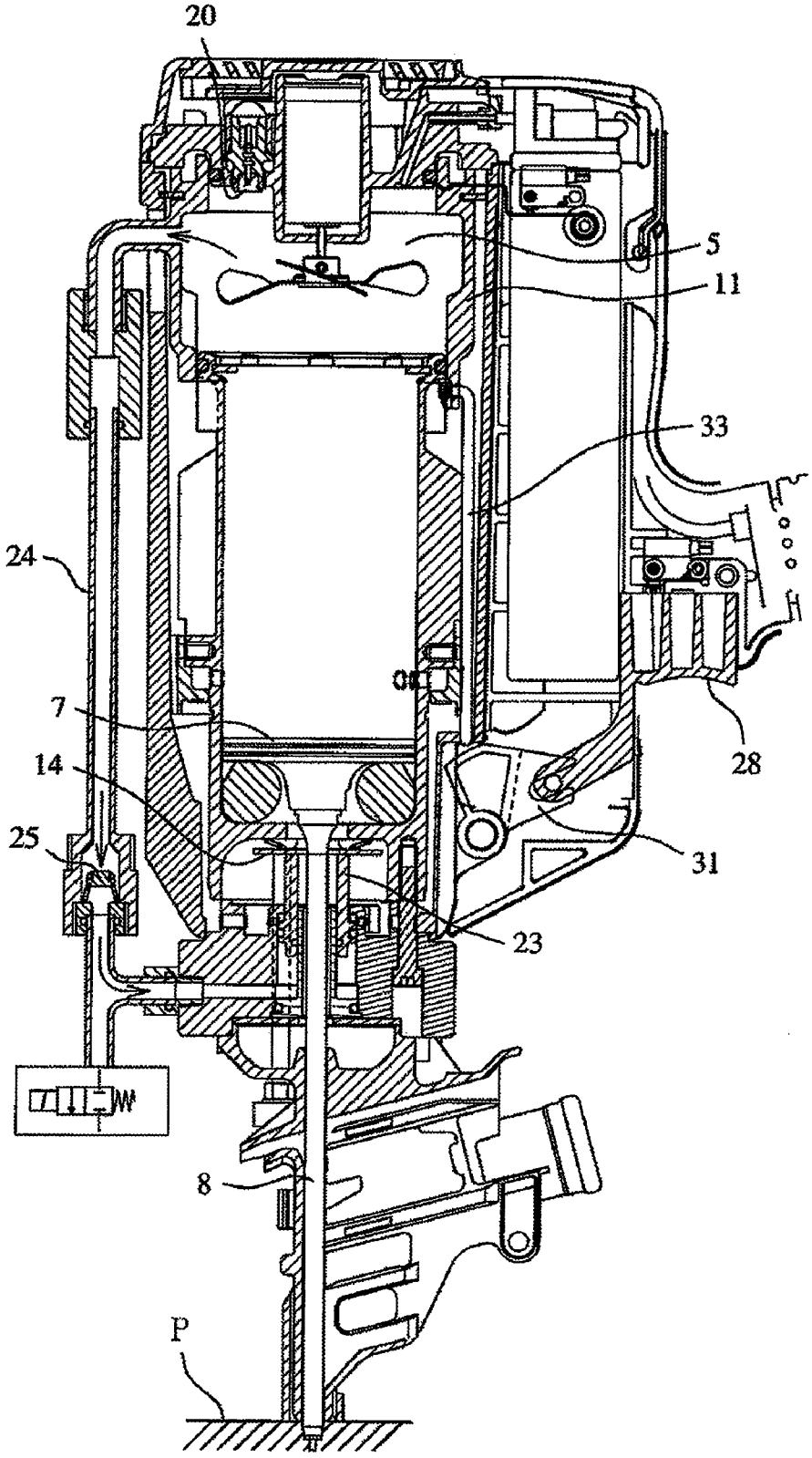
FIG. 6 is a longitudinal sectional diagram showing a state at the time of the driving operation.

Next, as shown in FIG. 6, when the trigger 28 is pulled, the ignition plug 20 ignites the mixed gas and so the mixed gas is burnt and explosively expands. The pressure of the combustion gas acts on the upper surface of the striking piston 7 to drive the striking piston downward, so that the driver 8 strikes a head nail (not shown) supplied within the nose portion 3 to drive the head nail within the driven material P.

Simultaneously, a part of the combustion gas within the combustion chamber 5 is supplied to the lock cylinder 22 via the gas tube 24 to move the lock piston 23 up. Thus, the upper end of the lock piston 23 engages with the lower surface of the basket-shaped bottom portion 14 of the holding member 12 located at the upper position together with the movable sleeve 11 which already moves upward to constitute the combustion chamber 5.

Figure 7:
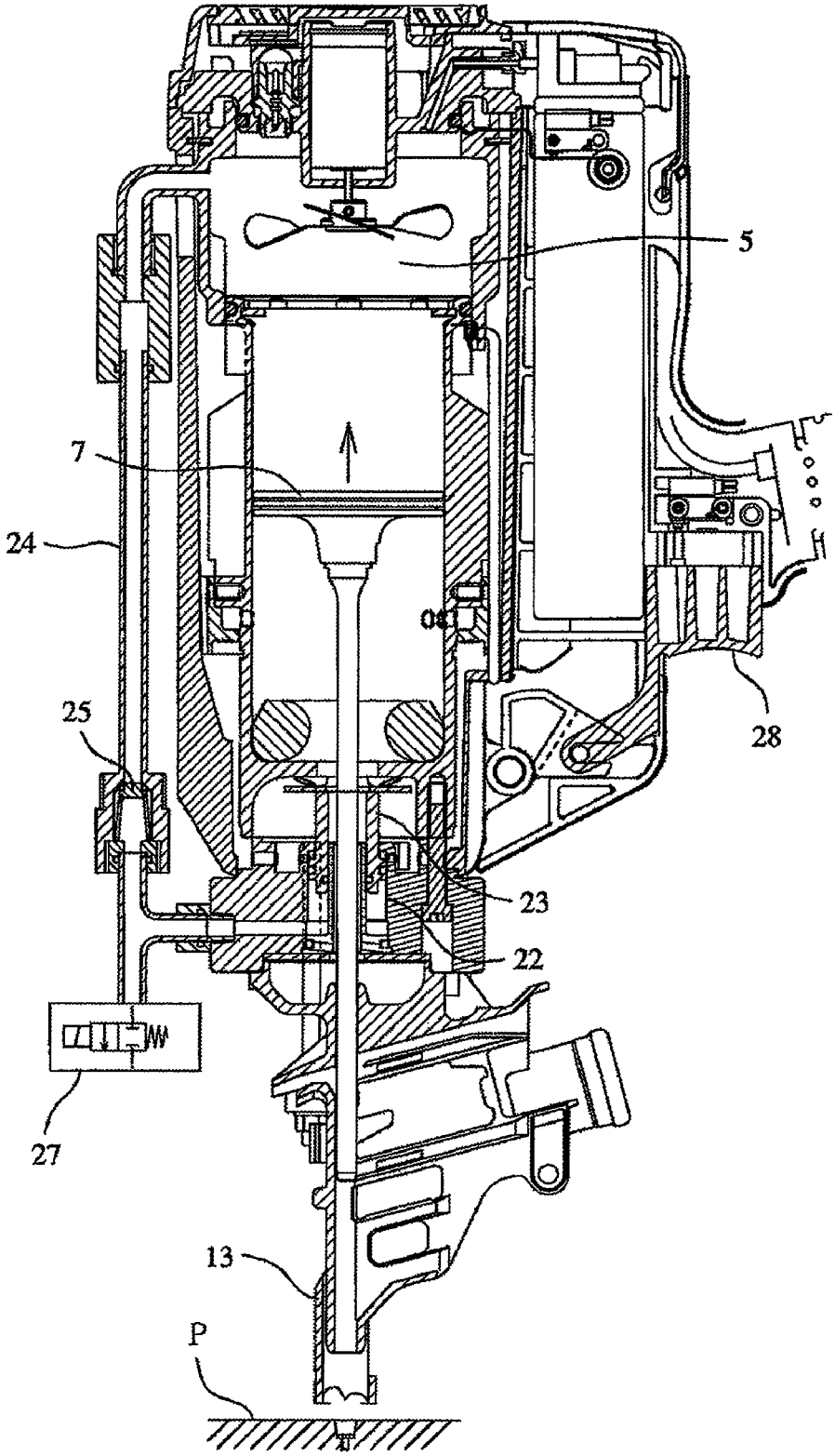
FIG. 7 is a longitudinal sectional diagram showing a state where the combustion chamber immediately after the completion of the driving operation of the nail driving machine is held.

When the driving operation completes, since the temperature within the combustion chamber 5 reduces abruptly, the pressure at the upper space of the striking piston 7 expanded to the striking cylinder 6 becomes negative, so that the volume of the space changes so as to reduce to an original volume due to the pressure difference between the upper space and the atmosphere from the lower direction. Thus, as shown in FIG. 7, the striking piston 7 returns to the top dead center. When the nail driving machine is separated from the driven member P, the contact arm 13 moves downward relatively due to its own weight.

However, although the gas within the gas tube 24 flows backward to the combustion chamber 5 when the pressure within the combustion chamber 5 becomes negative, such the backward flow of the gas within the gas tube 24 is prevented by the check valve 25, the pressure within the lock cylinder 22 does not reduce. Thus, the lock piston 23 is also kept at the same upper position and hence the sealing state of the combustion chamber 5 is held. Therefore, the combustion chamber 5 is opened after the pressure of the upper space becomes a sufficient negative value and the striking piston 7 returns to the top dead center.

Figure 8:
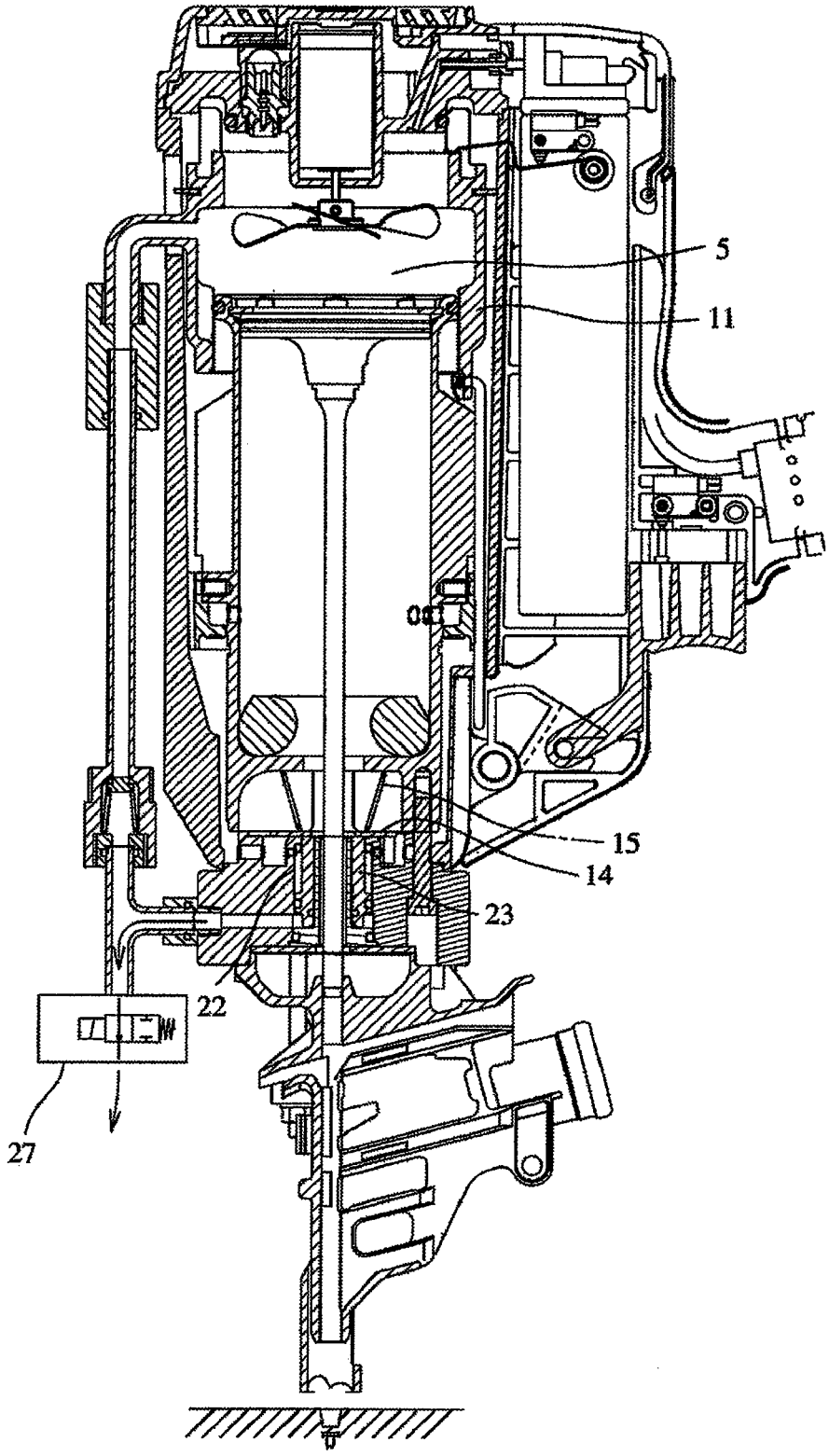
FIG. 8 is a longitudinal sectional diagram showing a state where the combustion chamber is opened.

Thereafter, as shown in FIG. 8, the electromagnetic valve 27 opens upon the lapse of the predetermined time period to exhaust the combustion gas within the gas tube 24. Thus, the lock piston 23 moves downward, and the movable sleeve 11 also moves downward together with the holding member 12 due to the spring 15, whereby the combustion chamber 5 is opened and the next driving operation is prepared.

At the time of driving, if the trigger 28 is pulled without pressing the contact arm 13 against the driven member, the lock plate 31 operatively linked with the trigger 28 engages with the side surface of the lockout bar 33 and so can not rotate, so that the trigger 28 can not be raised. When the trigger 28 is pulled after pressing the contact arm 13 against the driven member, the lock plate 31 rotates upward and the upper end thereof engages with the lower portion of the lockout bar 33. Thus, although the movable sleeve 11 does not move downward in the state where the trigger 28 is pulled, when the electromagnetic valve 27 is opened in a state where a finger is separated from the trigger 28 and the movable sleeve 11 moves downward, the plate 13 is pushed out and rotates downward due to the movement of the movable sleeve and restores to the original state.

As described above, the sealing state of the combustion chamber 5 can be surely held irrespective of the early or late operation of the trigger 28 or the reaction at the time of the driving operation etc.

The opening of the gas tube is not necessarily required to be performed by the electromagnetic valve and may be performed by a manually-operated valve. In this case, the holding of the sealed state of the combustion chamber can be freely controlled in accordance with the judgment of a worker.

Further, the aforesaid holding mechanism of the combustion chamber of the driving tool is not limited to be applied to the mail driving machine so long as the tool is the gas combustion type driving tool. The invention can be applied to a screw driving machine etc.

Furthermore, in the aforesaid embodiment, although the exhaust gas is sent via the gas tube coupled between the lock cylinder and the combustion chamber, the exhaust gas may be sent via a gas path provided at the body or the cylinder.

Furthermore, in the aforesaid embodiment, although the explanation is made as to a case where the contact arm provided separately from the nose portion is utilized as a means for moving the movable sleeve upward, a contact nose also serving as the nose portion may be utilized as the means.

Although the invention has been explained in detail with reference to the particular embodiment, it would be apparent for those skilled in the art that various modifications and variations may be made without departing from the spirit or scope of the invention.

The present application is based on Japanese Patent Application (Japanese Patent Appln. No. 2005-229364) filed on Aug. 8, 2005, the contents of which is incorporated herein by reference.

INDUSTRIAL APPLICABILITY

The invention is applicable for a gas combustion type driving tool in which a mixed gas of a combustible gas and an air is explosively burnt within a combustion chamber which is formed by moving a movable sleeve upward to seal a space thereof thereby to perform a driving operation.

The invention claimed is:

1. A gas combustion type driving tool, comprising:

a striking cylinder disposed within a body;

a striking piston accommodated within the striking cylinder so as to be movable in an up/down direction;

a movable sleeve fitted on an outside of the striking cylinder so as to be movable in the up/down direction;

a holding member interlocked with the movable sleeve;

a combustion chamber;

a lock cylinder;

a lock piston accommodated within the lock cylinder so as to be movable in the up/down direction and capable of being engaged with the holding member;

a gas path that couples the lock cylinder with the combustion chamber;

a check valve provided at the gas path; and a valve device provided at the lock cylinder.

2. The gas combustion type driving tool according to claim 1, wherein the lock cylinder is disposed beneath the movable sleeve.

3. The gas combustion type driving tool according to claim 1, wherein the combustion chamber is formed by an upper end surface of the striking piston and the movable sleeve.

4. The gas combustion type driving tool according to claim 1, further comprising:

a contact arm movable in the up/down direction along a nose portion provided beneath the striking cylinder, wherein the movable sleeve is linked with the contact arm via the holding member, and the contact arm and the movable sleeve are urged downward.

5. The gas combustion type driving tool according to claim 1, wherein the check valve prevents gas within the gas path from flowing backward to a side of the combustion chamber.

6. The gas combustion type driving tool according to claim 1, when a part of combustion gas within the combustion chamber is supplied to the lock cylinder via the gas path, the lock piston is pushed upward and an upper end of the lock piston is engaged with the holding member.

7. The gas combustion type driving tool according to claim 1, wherein the valve device comprises an electromagnetic valve which is opened upon lapse of a predetermined time period after combustion within the combustion chamber.

8. The gas combustion type driving tool according to claim 7, wherein the predetermined time period is a time period from a time point where a driving operation starts to a time point where the driving operation is completed and the striking piston moves and restores to a top dead center.

9. The gas combustion type driving tool according to claim 1, wherein the valve device is a manually-operated valve.

* * * * *